US006962399B2

(12) United States Patent
Anderson et al.

(10) Patent No.: US 6,962,399 B2
(45) Date of Patent: Nov. 8, 2005

(54) METHOD OF WARNING A USER OF END OF LIFE OF A CONSUMABLE FOR AN INK JET PRINTER

(75) Inventors: Frank Edward Anderson, Sadieville, KY (US); George Keith Parish, Winchester, KY (US); Timothy Strunk, Lexington, KY (US); John Dennis Zbrozek, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 19 days.

(21) Appl. No.: 10/335,221

(22) Filed: Dec. 30, 2002

(65) Prior Publication Data

US 2004/0125160 A1 Jul. 1, 2004

(51) Int. Cl.[7] ..... B41J 29/38

(52) U.S. Cl. ..... 347/14; 347/7; 347/5; 347/19

(58) Field of Search ..... 347/7, 9, 12, 40, 347/5, 41, 14, 19

(56) References Cited

U.S. PATENT DOCUMENTS

| | | | | |
|---|---|---|---|---|
| 4,771,313 A | | 9/1988 | Kuroda et al. | 357/3 R |
| 4,851,875 A | | 7/1989 | Tanimoto | 355/245 |
| 4,922,294 A | | 5/1990 | Nakagami et al. | 355/209 |
| 4,961,088 A | | 10/1990 | Gilliland et al. | 355/206 |
| 5,132,711 A | | 7/1992 | Shinada et al. | 346/140 |
| 5,491,540 A | | 2/1996 | Hirst | 355/200 |
| 5,541,629 A | * | 7/1996 | Saunders et al. | 347/12 |
| 5,598,189 A | | 1/1997 | Hess et al. | 347/9 |
| 5,610,635 A | | 3/1997 | Murray et al. | 347/7 |
| 5,617,122 A | | 4/1997 | Numata et al. | 347/14 |
| 5,646,660 A | | 7/1997 | Murray | 347/59 |
| 5,663,750 A | * | 9/1997 | Sakuma | 347/7 |
| 5,682,140 A | | 10/1997 | Christensen et al. | 340/540 |
| 5,682,183 A | | 10/1997 | Wade et al. | 347/7 |
| 5,682,184 A | | 10/1997 | Stephany et al. | 347/7 |
| 5,699,090 A | | 12/1997 | Wade et al. | 347/7 |
| 5,699,091 A | | 12/1997 | Bullock et al. | 347/19 |
| 5,708,912 A | | 1/1998 | Lee | 399/24 |
| 5,731,824 A | | 3/1998 | Kneezel et al. | 347/7 |
| 5,736,997 A | | 4/1998 | Bolash et al. | 347/19 |
| 5,758,224 A | | 5/1998 | Binder et al. | 399/25 |
| 5,797,061 A | | 8/1998 | Overall et al. | 399/27 |
| 5,802,420 A | | 9/1998 | Garr et al. | 379/129 |
| 5,805,953 A | | 9/1998 | Kikuchi et al. | 399/43 |
| 5,835,817 A | | 11/1998 | Bullock et al. | 399/25 |
| 5,835,818 A | | 11/1998 | Hoshika et al. | 399/26 |

(Continued)

FOREIGN PATENT DOCUMENTS

JP 07125311 * 5/1995

*Primary Examiner*—Hai Pham
*Assistant Examiner*—Lam Nguyen
(74) *Attorney, Agent, or Firm*—Scott N. Barker, Esq.; Taylor & Aust, P.C.

(57) ABSTRACT

A method informs a user of an ink jet printer of the end of life of a consumable. The consumable supplies ink to a printhead having a plurality of ink ejection nozzles and an associated plurality of ink jetting actuators, each of the plurality of ink jetting actuators being addressable. The printhead includes a plurality of address lines for facilitating selection of one or more of the plurality of ink jetting actuators. The method includes the steps of defining a notice threshold that is associated with a corresponding amount of ink remaining in the consumable; providing control logic for selectively controlling the plurality of address lines; determining whether the amount of ink remaining in the consumable has reached the notice threshold; and upon reaching the notice threshold, reducing an image density of images formed by the printhead by selectively disabling at least one of the plurality of address lines.

12 Claims, 9 Drawing Sheets

U.S. PATENT DOCUMENTS

| | | | | |
|---|---|---|---|---|
| 5,900,888 | A | 5/1999 | Kurosawa | 347/7 |
| 5,923,918 | A | 7/1999 | Nakagawa et al. | 399/27 |
| 5,929,875 | A | 7/1999 | Su et al. | 347/19 |
| 5,943,525 | A | 8/1999 | Endo et al. | 399/27 |
| 5,970,275 | A | 10/1999 | Brown, Jr. et al. | 399/27 |
| 5,572,292 | A | 11/1999 | Chatani et al. | 399/25 |
| 5,995,774 | A | 11/1999 | Applegate et al. | 399/27 |
| 5,997,121 | A | 12/1999 | Altfather et al. | 347/7 |
| 6,000,773 | A | 12/1999 | Murray et al. | 347/7 |
| 6,007,173 | A | 12/1999 | DeLouise et al. | 347/7 |
| 6,191,913 | B1 | 12/1999 | Nicklos | 360/99.04 |
| 6,106,088 | A | 8/2000 | Wafler | 347/7 |
| 6,116,715 | A | 9/2000 | Lefebvre et al. | 347/19 |
| 6,116,717 | A | 9/2000 | Anderson et al. | 347/19 |
| 6,145,959 | A | 11/2000 | Lund et al. | 347/40 |
| 6,151,039 | A | 11/2000 | Hmelar et al. | 347/7 |
| 6,155,664 | A | 12/2000 | Cook | 347/7 |
| 6,190,000 | B1 * | 2/2001 | Krouss et al. | 347/40 |
| 6,196,651 | B1 | 3/2001 | Zuber et al. | 347/7 |
| 6,227,643 | B1 | 5/2001 | Purcell et al. | 347/19 |
| 6,234,597 | B1 | 5/2001 | Suzuki et al. | 347/7 |
| 6,234,603 | B1 | 5/2001 | Altfather et al. | 347/19 |
| 6,246,841 | B1 | 6/2001 | Merrifield et al. | 399/27 |
| 6,290,321 | B1 | 9/2001 | Murray et al. | 347/19 |
| 6,295,423 | B1 | 9/2001 | Haines et al. | 399/24 |
| 6,312,072 | B1 | 11/2001 | Hough | 347/7 |
| 6,360,174 | B1 | 3/2002 | Shoki | 702/55 |
| 6,366,744 | B1 | 4/2002 | Phillips et al. | 399/24 |
| 6,375,298 | B2 | 4/2002 | Purcell et al. | 347/14 |
| 6,408,143 | B2 | 6/2002 | Sakurai et al. | 399/27 |
| 6,409,302 | B2 | 6/2002 | Altfather et al. | 347/19 |
| 6,474,771 | B2 | 11/2002 | Kim | 347/19 |
| 2001/0004423 | A1 | 6/2001 | Kakeshita et al. | 399/24 |
| 2001/0013939 | A1 | 8/2001 | Weaver et al. | 358/1.3 |
| 2001/0021313 | A1 | 9/2001 | Machara | 399/12 |
| 2001/0021314 | A1 | 9/2001 | Hibi | 399/27 |
| 2001/0035887 | A1 | 11/2001 | Altfather et al. | 347/7 |
| 2001/0043259 | A1 | 11/2001 | Ogata | 347/140 |
| 2002/0020559 | A1 | 2/2002 | Murray et al. | 347/50 |
| 2002/0021907 | A1 | 2/2002 | Itoh | 399/27 |
| 2002/0025173 | A1 | 2/2002 | Isobe et al. | 399/12 |
| 2002/0025177 | A1 | 2/2002 | Yokoi et al. | 399/27 |
| 2002/0037173 | A1 | 3/2002 | Kakeshita | 399/27 |

* cited by examiner

HORIZONTAL POSITION

ADDRESS SEQUENCE

| | 1 | 2 | 3 | 4 | 5 | 6 | 7 | 8 | 9 | 10 | 11 | 12 | ... |
|---|---|---|---|---|---|---|---|---|---|---|---|---|---|
| 7 | | | | | | | X | | | | | | |
| 4 | | | | X | | | | | | | | | |
| 1 | X | | | | | | | | | | X | | |
| 8 | | | | | | | | X | | | | | |
| 5 | | | | | X | | | | | | | | |
| 2 | | X | | | | | | | | | | X | |
| 9 | | | | | | | | | X | | | | |
| 6 | | | | | | X | | | | | | | |
| 3 | | | X | | | | | | | | | | |
| 10 | | | | | | | | | | X | | | |

Fig. 6A

HORIZONTAL POSITION

ADDRESS SEQUENCE

| | 1 | 2 | 3 | 4 | 5 | 6 | 7 | 8 | 9 | 10 | 11 | 12 | ... |
|---|---|---|---|---|---|---|---|---|---|---|---|---|---|
| 7 | | X | | | | | X | | | | | X | |
| 4 | | | | X | | | | | X | | | | |
| 1 | X | | | | | X | | | | | X | | |
| 8 | | | X | | | | | X | | | | | |
| 5 | | | | | X | | | | | X | | | |
| 2 | | X | | | | | X | | | | | X | |
| 9 | | | | X | | | | | X | | | | |
| 6 | X | | | | | X | | | | | X | | |
| 3 | | | X | | | | | X | | | | | |
| 10 | | | | | X | | | | | X | | | |

Fig. 6B

HORIZONTAL POSITION

ADDRESS SEQUENCE

| | 1 | 2 | 3 | 4 | 5 | 6 | 7 | 8 | 9 | 10 | 11 | 12 | ... |
|---|---|---|---|---|---|---|---|---|---|---|---|---|---|
| 7 | X | | | | X | | X | | | | X | | |
| 4 | | X | | X | | | | X | | | | X | |
| 1 | X | | | | X | | | | X | | X | | |
| 8 | | X | | | | X | | X | | | | X | |
| 5 | | | X | | X | | | | X | | | | |
| 2 | | X | | | | X | | | | X | | X | |
| 9 | | | X | | | | X | | X | | | | |
| 6 | | | | X | | X | | | | X | | | |
| 3 | X | | X | | | | X | | | | X | | |
| 10 | | | | X | | | | X | | X | | | |

Fig. 6C

HORIZONTAL POSITION

| ADDRESS SEQUENCE | 1 | 2 | 3 | 4 | 5 | 6 | 7 | 8 | 9 | 10 | 11 | 12 | ... |
|---|---|---|---|---|---|---|---|---|---|---|---|---|---|
| 7 | X | | X | | X | | X | | | | X | | |
| 4 | | X | | X | | | | X | | X | | X | |
| 1 | X | | | | X | | X | | X | | X | | |
| 8 | | X | | X | | X | | X | | | | X | |
| 5 | X | | X | | X | | | | X | | X | | |
| 2 | | X | | | | X | | X | | X | | X | |
| 9 | | | X | | X | | X | | X | | | | |
| 6 | | X | | X | | X | | | | X | | X | |
| 3 | X | | X | | | | X | | X | | X | | |
| 10 | | | | X | | X | | X | | X | | | |

Fig. 6D

HORIZONTAL POSITION

| ADDRESS SEQUENCE | 1 | 2 | 3 | 4 | 5 | 6 | 7 | 8 | 9 | 10 | 11 | 12 | ... |
|---|---|---|---|---|---|---|---|---|---|---|---|---|---|
| 7 | X | | X | | X | | X | | X | | X | | |
| 4 | | X | | X | | X | | X | | X | | X | |
| 1 | X | | X | | X | | X | | X | | X | | |
| 8 | | X | | X | | X | | X | | X | | X | |
| 5 | X | | X | | X | | X | | X | | X | | |
| 2 | | X | | X | | X | | X | | X | | X | |
| 9 | X | | X | | X | | X | | X | | X | | |
| 6 | | X | | X | | X | | X | | X | | X | |
| 3 | X | | X | | X | | X | | X | | X | | |
| 10 | | X | | X | | X | | X | | X | | X | |

Fig. 6E

HORIZONTAL POSITION

| ADDRESS SEQUENCE | 1 | 2 | 3 | 4 | 5 | 6 | 7 | 8 | 9 | 10 | 11 | 12 | ... |
|---|---|---|---|---|---|---|---|---|---|---|---|---|---|
| 7 | X | | X | | X | | X | | X | X | X | | |
| 4 | | X | | X | | X | X | X | | X | | X | |
| 1 | X | | X | X | X | | X | | X | | X | | |
| 8 | X | X | | X | | X | | X | | X | X | X | |
| 5 | X | | X | | X | | X | X | X | | X | | |
| 2 | | X | | X | X | X | | X | | X | | X | |
| 9 | X | X | X | | X | | X | | X | | X | X | |
| 6 | | X | | X | | X | | X | X | X | | X | |
| 3 | X | | X | | X | X | X | | X | | X | | |
| 10 | | X | X | X | | X | | X | | X | | X | |

Fig. 6F

HORIZONTAL POSITION

ADDRESS SEQUENCE

| | 1 | 2 | 3 | 4 | 5 | 6 | 7 | 8 | 9 | 10 | 11 | 12 | ... |
|---|---|---|---|---|---|---|---|---|---|---|---|---|---|
| 7 | | X | | X | X | X | X | | X | X | | X | |
| 4 | X | X | X | X | | X | X | | X | | X | X | |
| 1 | X | | X | X | | X | | X | X | X | X | | |
| 8 | X | | X | | X | X | X | X | | X | X | | |
| 5 | | X | X | X | X | | X | X | | X | | X | |
| 2 | X | X | | X | X | | X | | X | X | X | X | |
| 9 | X | X | | X | | X | X | X | X | | X | X | |
| 6 | X | | X | X | X | X | | X | X | | X | | |
| 3 | X | X | X | | X | X | | X | | X | X | X | |
| 10 | | X | X | | X | | X | X | X | X | | X | |

Fig. 6G

HORIZONTAL POSITION

ADDRESS SEQUENCE

| | 1 | 2 | 3 | 4 | 5 | 6 | 7 | 8 | 9 | 10 | 11 | 12 | ... |
|---|---|---|---|---|---|---|---|---|---|---|---|---|---|
| 7 | X | X | | X | X | X | X | | X | X | X | X | |
| 4 | X | X | X | X | | X | X | X | X | | X | X | |
| 1 | X | | X | X | X | X | | X | X | X | X | | |
| 8 | X | X | X | | X | X | X | X | | X | X | X | |
| 5 | | X | X | X | X | | X | X | X | X | | X | |
| 2 | X | X | | X | X | X | X | | X | X | X | X | |
| 9 | X | X | X | X | | X | X | X | X | | X | X | |
| 6 | X | | X | X | X | X | | X | X | X | X | | |
| 3 | X | X | X | | X | X | X | X | | X | X | X | |
| 10 | | X | X | X | X | | X | X | X | X | | X | |

Fig. 6H

HORIZONTAL POSITION

ADDRESS SEQUENCE

| | 1 | 2 | 3 | 4 | 5 | 6 | 7 | 8 | 9 | 10 | 11 | 12 | ... |
|---|---|---|---|---|---|---|---|---|---|---|---|---|---|
| 7 | X | X | X | X | X | X | X | | X | X | X | X | |
| 4 | X | X | X | X | | X | X | X | X | X | X | X | |
| 1 | X | | X | X | X | X | X | X | X | X | X | | |
| 8 | X | X | X | X | X | X | X | X | | X | X | X | |
| 5 | X | X | X | X | X | | X | X | X | X | X | X | |
| 2 | X | X | | X | X | X | X | X | X | X | X | X | |
| 9 | X | X | X | X | X | X | X | X | X | | X | X | |
| 6 | X | X | X | X | X | X | | X | X | X | X | X | |
| 3 | X | X | X | | X | X | X | X | X | X | X | X | |
| 10 | | X | X | X | X | X | X | X | X | X | | X | |

Fig. 6I

| | HORIZONTAL POSITION | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | ... |
| NO. OF ADDRESS LINES TO BE DISABLED | 0 | 2 | 1 | 8 | 6 | 4 | 3 | 9 | 5 | 7 | 2 | 1 | 8 | 6 | ... |
| ADDRESS DISABLE PATTERN (SEE FIG. NO.) | NONE | 6B | 6A | 6H | 6F | 6D | 6C | 6I | 6E | 6G | 6B | 6H | 6A | 6F | |

Fig. 7

| MSB OF INPUT DATA | ADDRESS LINE TO BE DISABLED |
|---|---|
| 0000 | 16 |
| 0001 | 1 |
| 0010 | 2 |
| 0011 | 3 |
| 0100 | 4 |
| 0101 | 5 |
| 0110 | 6 |
| 0111 | 7 |
| 1000 | 8 |
| 1001 | 9 |
| 1010 | 10 |
| 1011 | 11 |
| 1100 | 12 |
| 1101 | 13 |
| 1110 | 14 |
| 1111 | 15 |

Fig. 8

| NO. OF ADDRESS LINES DROPPED | ADDRESS LINES DROPPED |
|---|---|
| 1 | 1 |
| 2 | 1, 3 |
| 3 | 1, 3, 5, |
| 4 | 1, 3, 5, 7 |
| 5 | 1, 3, 5, 7, 9, |
| 6 | 1, 3, 5, 7, 9, 11 |
| 7 | 1, 3, 5, 7, 9, 11, 13 |
| 8 | 1, 2, 3, 5, 7, 9, 11, 13 |
| 9 | 1, 2, 3, 4, 5, 7, 9, 11, 13, |
| 10 | 1, 2, 3, 4, 5, 6, 7, 9, 11, 13 |
| 11 | 1, 2, 3, 4, 5, 6, 7, 8, 9, 11, 13 |
| 12 | 1, 2, 3, 4, 5, 6, 7, 8, 9, 10, 11, 13 |

Fig. 9A

| HORIZONTAL POSITION | ADDRESS LINES DROPPED |
|---|---|
| 1 | 1, 3, 5 |
| 2 | 2, 4, 6 |
| 3 | 3, 5, 7 |
| 4 | 4, 6, 8 |
| 5 | 5, 7, 9 |
| 6 | 6, 8, 10 |
| 7 | 7, 9, 11 |
| 8 | 8, 10, 12 |
| 9 | 9, 11, 13 |
| 10 | 10, 12, 1 |
| 11 | 11, 13, 2 |
| 12 | 12, 1, 3 |
| 13 | 13, 2, 4 |
| 14 | 1, 3, 5 |

Fig. 9B

METHOD OF WARNING A USER OF END OF LIFE OF A CONSUMABLE FOR AN INK JET PRINTER

BACKGROUND OF THE INVENTION

1. Field of the Invention

The present invention relates to an ink jet printer, and, more particularly, to a method of informing a user of the end of life of a consumable for an ink jet printer.

2. Description of the Related Art

An ink jet printer typically has associated therewith a consumable, such as for example, an ink supply tank or an ink jet cartridge, that contains a supply of ink that is consumed during an imaging process. During the imaging process, ink is selectively ejected from a plurality of nozzles in a printhead to form a printed image. Eventually, the ink supply is exhausted. In either event, the consumer may be inconvenienced by an untimely exhaustion of the ink supply of the consumable. By providing a notice to the consumer of the upcoming exhaustion of the ink supply, provisions can be made in advance of the exhaustion of ink for replacing or refilling the consumable.

One such method of providing such a notice to the user is to notify the user of the reduced ink that remains in the consumable, such as, for example, by reducing the density of a printed image. In one known implementation of this method, the duration of a preheat pulse applied to a heater in the printhead is changed so as to affect the amount of ink expelled from the associated nozzle. By shortening the preheat pulse, the size of the expelled ink drop is reduced, thereby decreasing the density of the printed image. Another approach is to change to a draft mode from another printing mode when a certain ink level is reached to thereby reduce the recording pixel numbers.

What is needed in the art is a method of informing a user of the end of life of a consumable for an ink jet printer, that does not require a change in the pulse width of a preheat pulse nor a changeover to a draft mode from another printing mode.

SUMMARY OF THE INVENTION

The present invention provides a method of informing a user of the end of life of a consumable for an ink jet printer, that does not require a change in the pulse width of a preheat pulse nor a changeover to a draft mode from another printing mode.

In one form thereof, the invention relates to a method of informing a user of an ink jet printer of the end of life of a consumable. The consumable supplies ink to a printhead. The printhead includes a plurality of ink ejection nozzles and an associated plurality of ink jetting actuators, each of the plurality of ink jetting actuators being addressable. The printhead includes a plurality of address lines for facilitating selection of one or more of the plurality of ink jetting actuators. The term "address line(s)" is used herein to refer to any signal path that is used to select a particular ink jetting actuator, or group of ink jetting actuators, from among a plurality of ink jetting actuators, and can be for example, primary address lines, secondary address lines, data lines, power lines, ground lines and auxiliary control lines.

The method includes the steps of defining a notice threshold that is associated with a corresponding amount of ink remaining in the consumable; providing control logic for selectively controlling the plurality of address lines; determining whether the amount of ink remaining in the consumable has reached the notice threshold; and upon reaching the notice threshold, reducing an image density of images formed by the printhead by selectively masking at least one of the plurality of address lines.

In another form thereof, the present invention relates to an ink jet printer. The ink jet printer includes a carriage for carrying a printhead. The printhead is connected in fluid communication with a consumable, the consumable containing a supply of ink. The printhead includes a plurality of ink ejection nozzles and an associated plurality of ink jetting actuators. A plurality of address lines is connected to the plurality of ink jetting actuators for facilitating selection of one or more of the plurality of ink jetting actuators. A switching unit is connected to the plurality of address lines for selectively masking the plurality of address lines. A device determines an amount of ink remaining in the consumable. A memory stores a notice threshold associated with a corresponding amount of ink remaining in the consumable. A controller is coupled to the switching unit, to the device and to the memory. The controller reads the amount of ink from the device and compares the amount of ink with the notice threshold stored in the memory. Upon the amount of ink reaching the notice threshold, the controller supplies signals to the switching unit for selectively individually masking at least one of the plurality of address lines to reduce an image density of images formed by the printhead.

In another form thereof, the present invention is directed to a printhead. The printhead includes a plurality of ink ejection nozzles. A plurality of ink jetting actuators is associated with the plurality of ink ejection nozzles. A plurality of address lines is connected to the plurality of ink jetting actuators for facilitating selection of one or more of the plurality of ink jetting actuators. A switching unit is connected to the plurality of address lines for selectively masking the plurality of address lines. A device determines an amount of usage of the printhead. A memory stores a notice threshold associated with a corresponding amount of ink remaining in a consumable. A controller is connected to the switching unit, to the device and to the memory. The controller reads the amount of usage from the device and compares the amount of usage with the notice threshold stored in the memory. Upon the amount of usage reaching the notice threshold, the controller supplies signals to the switching unit for selectively individually masking at least one of the plurality of address lines to reduce an image density of images formed by the printhead.

An advantage of the present invention is that the progressive depletion of the image density can be maintained relatively uniform for a printed page, so that the user does not confuse the exhaustion of the ink supply with a failure of the printer and/or printhead.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIGS. 6A–6I depict exemplary predetermined address line masking patterns.

FIG. 7 is depicts an exemplary predetermined address line masking pattern, wherein the number of masked address lines changes based on the horizontal position of the printhead.

FIG. 8 depicts a pseudo-random selection of address line masking based on an input data bit sequence.

FIG. 9A depicts a pseudo-random selection of address lines for masking, based on a predefined offset between numerically sequential address lines.

FIG. 9B depicts a pseudo-random selection of address line masking, wherein the number of address lines masked per horizontal position is constant.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
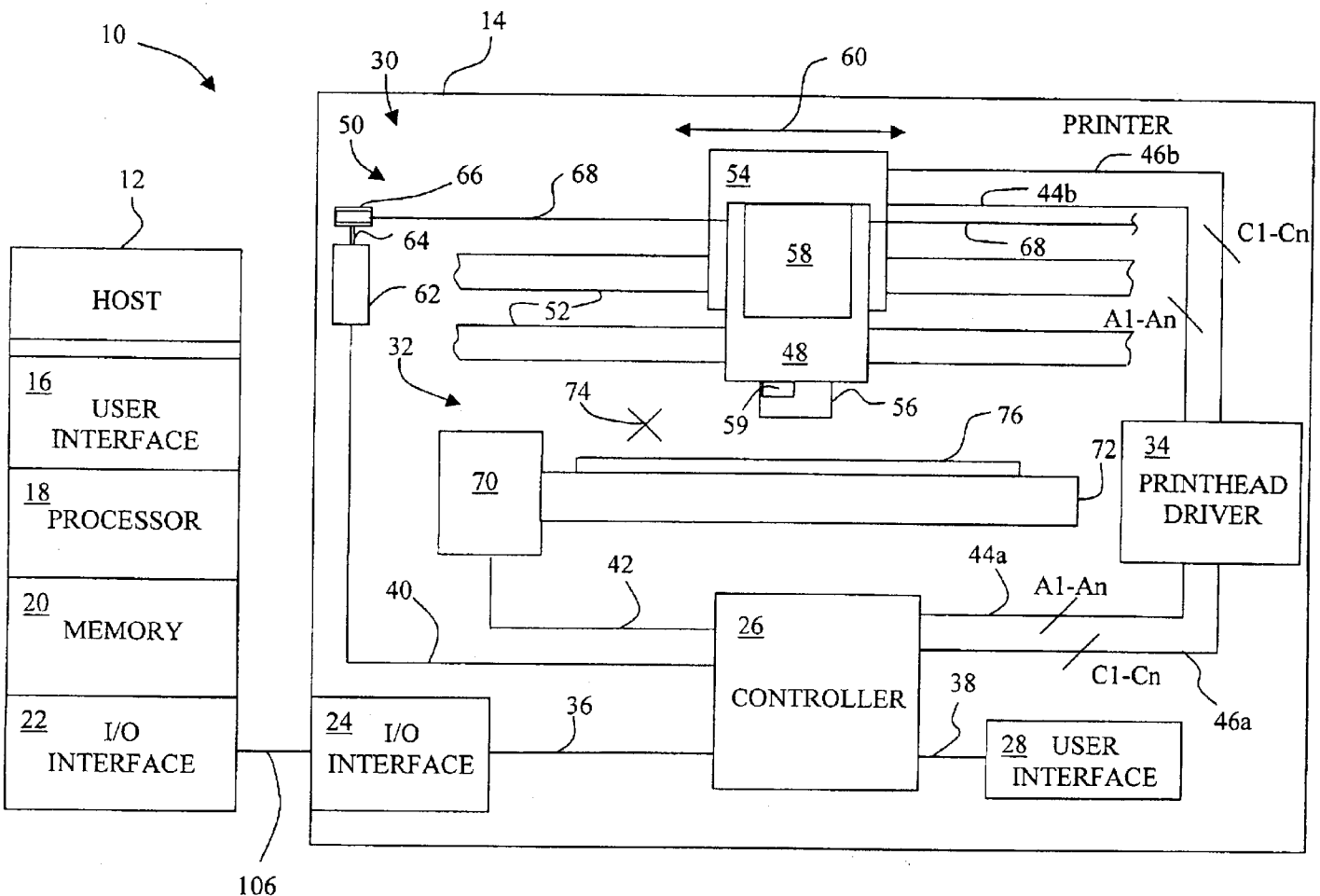
FIG. 1 is a diagrammatic illustration of a printing system embodying the invention.

Referring now to the drawings, and particularly to FIG. 1, there is shown a diagrammatic illustration of a printing system 10 for implementing the method of the present invention. Printing system 10 includes a host 12 and an ink jet printer 14.

Host 12 includes a user interface 16, a processor 18, a memory 20 and an input/output (I/O) interface 22. Host 12 may be, for example, a personal computer. User interface 16 includes, for example, a display screen, such as a CRT or LCD display, speakers and an input device, such as a keyboard and mouse, to facilitate providing visual and/or aural output to a user and to facilitate user input. Processor 18 executes program instructions that are stored in memory 20. Memory 20 includes computer applications programs that generate image data and a printer driver that formats image data for use by ink jet printer 14, when executed by processor 18. Memory 20 includes, for example, RAM, ROM, NVRAM, and a mass data storage device, such as a hard drive, CD-ROM and/or DVD units. I/O interface 22 facilitates communications with an external device, such as ink jet printer 14.

Ink jet printer 14 includes an I/O interface 24, a controller 26, a user interface 28, a printhead carrier system 30, a media feed system 32 and a printhead driver 34.

Controller 26 is coupled via communications link 36 to I/O interface 24. Controller 26 is coupled via communications link 38 to user interface 28. Controller 26 is coupled via communications link 40 to printhead carrier system 30. Controller 26 is coupled via communications link 42 to media feed system 32. Controller 26 is coupled to a printhead 56 via a plurality of address lines and printhead driver 34. The term "address line(s)" is used herein to refer to any signal path that is used to select a particular ink jetting actuator, or group of ink jetting actuators, from among a plurality of ink jetting actuators, and can be for example, primary address lines 44*a*, 44*b* (A1–An), secondary address lines 46*a*, 46*b* (C1–Cn), data lines, power lines, ground lines and auxiliary control lines. For convenience and ease of discussion, the other lines, such as power, ground and auxiliary control lines that exist are not shown in FIG. 1. As is known in the art, an ink jetting actuator can be, for example, an electrical heating element or a piezoelectric element.

Controller 26 includes, for example, a processor and associated memory, such as RAM, ROM, and/or NVRAM. Controller 26 executes program instructions to control each of printhead carrier system 30 and media feed system 32, and to supply image data and address information to printhead driver 34, during an imaging operation.

User interface 28 includes, for example, a display screen, beeper, and an input device (e.g., keypad) to facilitate providing output to a user and to facilitate user input.

Printhead carrier system 30 includes a carriage 48, a carriage drive system 50, a pair of guide rods 52, and a printhead interface board 54. As shown, printhead carrier system 30 carries a printhead 56 and an ink tank 58 that are in fluid communication. Printhead 56 includes a logic unit 59 for carrying out pre-programmed logic and arithmetic operations, and includes memory for storing information associated with printhead 56, such as for example, usage threshold levels based on, for example, a count of the number of ink ejections, i.e., firings, by printhead 56. Printhead 56 and ink tank 58 may be formed as an integral unit, commonly referred to as an ink jet cartridge, or may be separable units that when connected are in fluid communication. Alternatively, ink tank 58 may be located remote from printhead carrier system 30 and fluidly coupled to printhead 56 via ink conduits.

Carriage 48 is slidably supported in ink jet printer 14 by guide rods 52. Guide rods 52 extend in a main scan direction depicted by doubleheaded arrow 60. Guide rods 52 thus define a main scan path for carriage 48 along the main scan direction. Accordingly, for convenience, each of the terms "main scan direction" and "main scan path" will be referenced with element number 60.

Carriage drive system 50 includes a motor 62 having a rotatable shaft 64. A drive pulley 66 is attached for rotation with shaft 64. Motor 62 receives drive signals from controller 26 via communications link 40. Drive pulley 66 is coupled via a belt 68 to carriage 48. Thus, controller 26 provides control signals to carriage drive system 50 so as to move carriage 48 in a reciprocating manner along main scan path 60 as drive pulley 66 is rotated by motor 62. Main scan direction 60 is sometimes referred to in the art as a horizontal direction.

Printhead interface board 54 is connected to printhead driver 34 by primary address lines 44*b* (A1–An) and secondary address lines 46*b* (A1–An). Printhead driver 34 conditions the signals arriving on primary address lines 44*a* and secondary address lines 46*a* so as to be at the proper voltage and current levels for printhead 56. The conditioned signals are supplied via primary address lines 44*b*, secondary address lines 46*b* and printhead interface board 54, to printhead 56.

Media feed system 32 includes a power transmission unit 70 and an index roller 72. Power transmission unit 70 provides a rotational force to rotate index roller 72. Power transmission unit includes, for example, a D.C. motor having a shaft that is rotatably coupled to index roller 72 via a gear train. Index roller 72 can be rotated in forward and reverse directions, the forward direction defining a sheet feed direction 74 for transporting a sheet of print media 76 during printing. Sheet feed direction 74 is depicted by an "X", thereby signifying that sheet feed direction 74 extends outwardly from FIG. 1 toward the reader. The sheet feed direction 74 is sometimes referred to in the art as the vertical direction, or the sub-scan direction.

Figure 2:
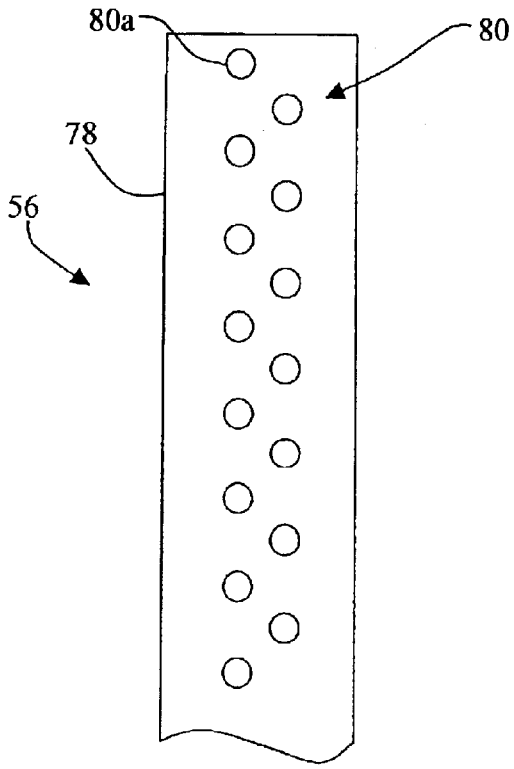
FIG. 2 is a front view of a nozzle plate of the printhead of FIG. 1.
Figure 3:
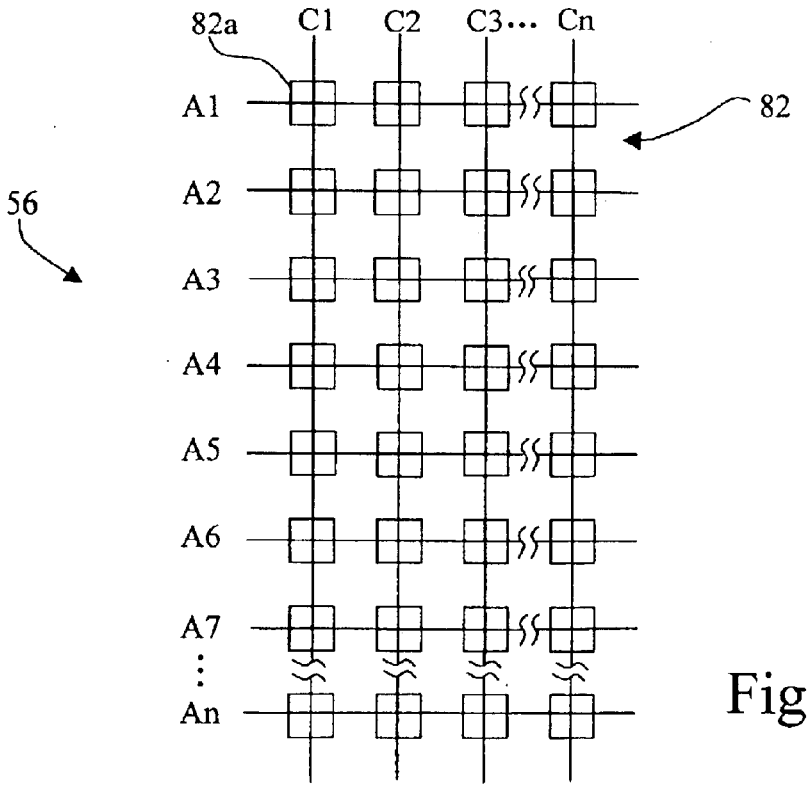
FIG. 3 is a graphical depiction of a matrix of ink jetting actuators of the printhead of FIG. 1.

Referring to FIG. 2, printhead 56 includes a nozzle plate 78 including a plurality of ink ejection nozzles 80, which are represented as two columns of circles. Referring to FIG. 3, printhead 56 includes an addressable actuator matrix including a plurality of actuators 82, which are represented by squares. The plurality of actuators 82 can be, for example, electrical heaters, or piezoelectric elements.

Each of the plurality of actuators 82 corresponds to a particular one of the plurality of ink ejection nozzles 80, which, when selected by a unique combination of a selected primary address line and a selected secondary address line, causes a drop of ink to be ejected from the corresponding ink ejection nozzle 80. For example, if controller 26 selects primary address line/secondary address line combination A1/C1, actuator 82*a* will be fired, and an ink drop will be ejected from the corresponding nozzle 80*a* of the plurality of ink ejection nozzles 80. As shown in FIG. 3, secondary address line C1 selects the first column of actuators, and an individual actuator in column C1 is selected by the selection of the desired one of primary address lines A1–An, wherein n represents the last of the primary address lines. Similarly, secondary address line C2 selects the second column of actuators, and an individual actuator in column C2 is selected by the selection of the desired one of primary address lines A1–An. Secondary address line C3 selects the third column of actuators, and an individual actuator in column C3 is selected by the selection of the desired one of primary address lines A1–An. Secondary address line Cn selects the nth column of actuators, and an individual actuator in column Cn is selected by the selection of the desired one of primary address lines A1–An. Alternatively, however, it is to be understood that primary address lines A1–An could be designated as secondary lines and secondary address lines C1–Cn designated as primary address lines through appropriate conversion of the received image data by controller 26 and/or printhead driver 34.

Figure 4:
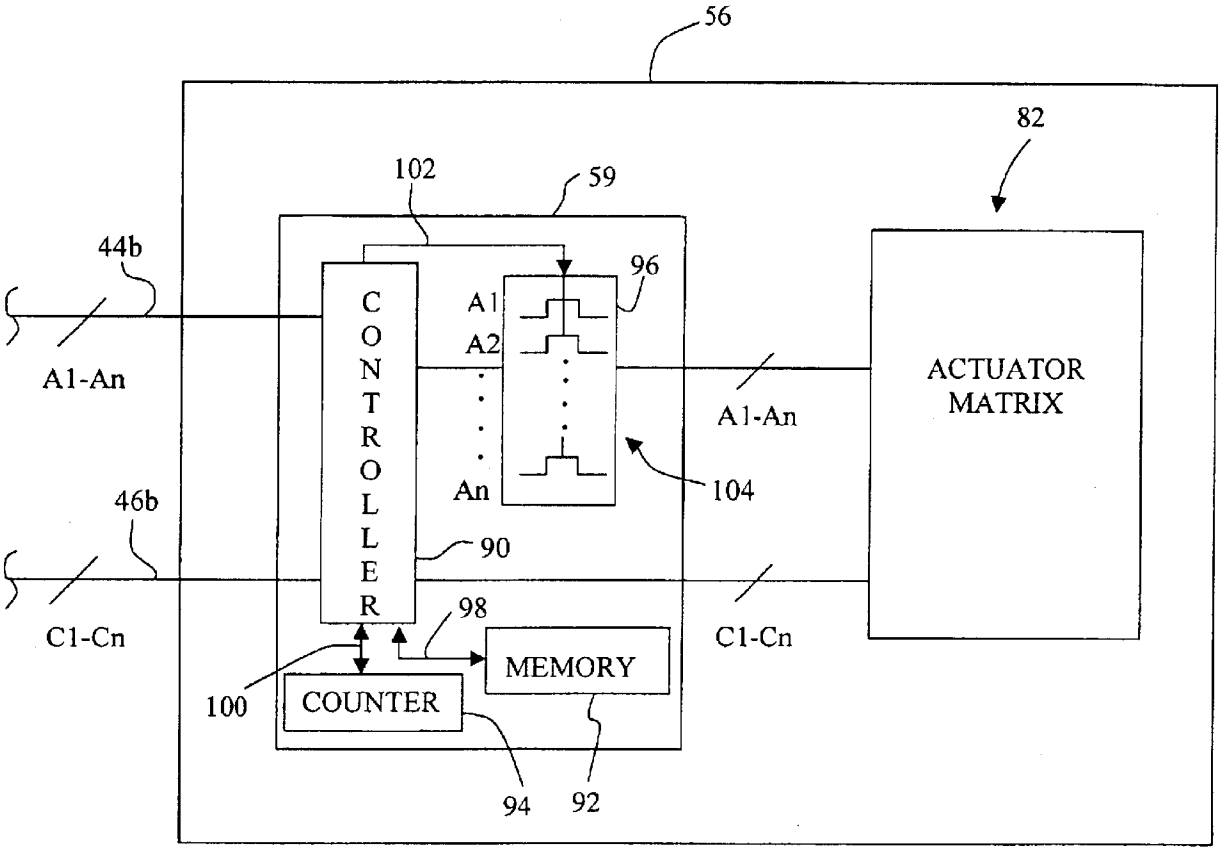
FIG. 4 is a block diagram illustrating electrical components included in the printhead of FIG. 1.

FIG. 4 is a block diagram depiction of printhead 56, including one embodiment of logic unit 59 and the matrix of the plurality of ink jetting actuators 82. Preferably, logic unit 59 and the matrix of the plurality of ink jetting actuators 82 are formed on a single printhead chip, also referenced by element number 56.

Logic unit 59 includes a controller 90, a memory 92, a counter 94 and a switching unit 96. Controller 90 is connected to primary address lines 44*b* and secondary address lines 46*b* for receiving address signals on individual address lines A1–An and C1–Cn. Controller 90 processes the address signals, and any auxiliary control signals, if applicable, to determine whether one or more of the plurality of ink jetting actuators 82 are to be fired, i.e., energized. A count of the number of such firings by the plurality of ink jetting actuators 82 is maintained by counter 94.

Memory 92 is coupled in bi-directional communications with controller 90 via electrical path 98. Memory 92 stores a plurality of count threshold levels. Each of the count threshold levels defines a level of ink depletion from ink tank 58, and preferably is stored in terms of a firing count of ink jetting actuators 82. A first count threshold, also referred to herein as a notice threshold, is a defined level at which a user will begin receiving notification that the usable ink supply in ink tank 58 is at its end of life. Other of the plurality of count thresholds define progressively lower amounts of ink remaining in ink tank 58.

Counter 94 is coupled in bi-directional communications with controller 90 via electrical path 100. Counter 94 maintains a count of the number of firings of the plurality of ink jetting actuators 82, i.e., the number of energizing pulses applied to the plurality of ink jetting actuators 82.

In the embodiment shown in FIG. 4, switching unit 96 is electrically coupled upstream of the plurality of ink jetting actuators 82. Switching unit 96 is communicatively coupled to controller 90 via an address select line 102. Switching unit 96 includes a plurality of individually selectable switching elements 104, such as FET transistors, for individually and selectively masking one or more of the address lines of printhead 56, such as for example, primary address lines A1–An. The individual selection of switching elements 104 is determined by controller 90, and is effected by the signals supplied to switching unit 96 via address select line 102.

Controller 90 periodically compares the count maintained in counter 94 with the plurality of count threshold levels to determine the notice action to be taken. In particular, the present invention will mask one or more of the address lines, for example primary address lines A1–An or secondary address lines C1–Cn, so as to progressively reduce the image density of an image printed on print media 76 by printhead 56, so as to warn the user of the end of life of the ink supply contained in ink tank 58. In one preferred implementation of the present invention, the masking of the address lines is momentary, or at least temporary.

With reference to FIGS. 1–4, during normal operation, host 12 supplies image data and print commands to ink jet printer 14 via communications link 106. Communications link 106 may be, for example, a direct electrical connection via a universal serial bus (USB) or parallel cable, or an optical link. Alternatively, communications link 106 can be an Ethernet local area network (LAN).

Controller 26 processes the received image data and command data, and generates the appropriate signals for addressing the appropriate actuator 82, and accordingly, ink ejection nozzle 80. Controller 26 provides drive signals to media feed system 32 to incrementally feed the sheet of print media 76 in sheet feed direction 74. At each increment of movement of the sheet of print media 76, controller 26 provides drive signals to carriage drive system 50 to drive carriage 48 carrying printhead 56 in a reciprocating manner along main scan path 60. During the movement of printhead 56 along main scan path 60, controller 26 selects certain combinations of address lines, such as for example, primary address lines (A1–An) and secondary address lines (C1–Cn), to thereby select and fire particular actuators of the plurality of ink jetting actuators 82, and in turn, eject an ink drop from the corresponding nozzles of the plurality of ink ejection nozzles 80.

During operation, an amount of ink consumed by ink jet printer 14 is estimated. This estimation may be based, for example, on the number of ink dots formed on print media 76, e.g., a total number of actuator firings of the plurality of actuators 82, or on the number of ink dots formed on print media 76 as compensated for by such factors as temperature, humidity and time. Alternatively, such an estimation of ink consumption can be based on a percent of image coverage on the printed sheets of media 76, the number of printed sheets exceeding a predetermined coverage amount, or simply the number of sheets of print media 76 processed by ink jet printer 14. Count threshold levels of corresponding units are stored in memory 92 of printhead 56. Preferably, this count associated with the amount of ink consumed by ink jet printer 14 is maintained in counter 94 of printhead 56, or alternatively, is maintained as an updateable count value stored in memory 92 of printhead 56. This estimation can be performed, for example, by controller 90 of printhead 56. Alternatively, through inclusion of appropriate logic, this estimation can be performed, for example, at any one of controller 26, printhead driver 34, or the printer driver software running on host 12.

Figure 5:
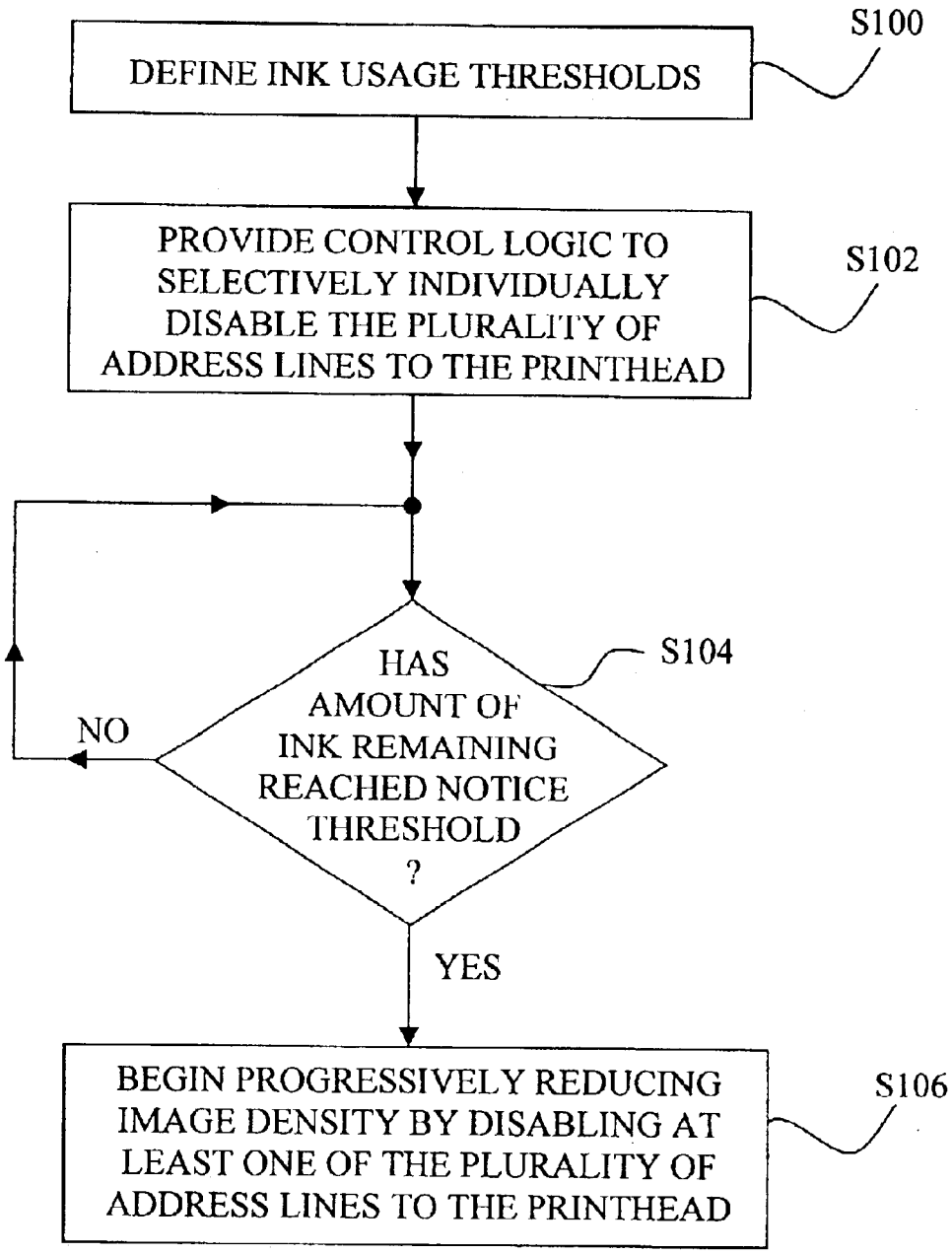
FIG. 5 is a general flowchart of one embodiment of a method for the present invention.

FIG. 5 is a flowchart of a method of informing a user of ink jet printer 14 that a usable supply of ink in ink tank 58 is at its end of life.

At step S100, a plurality of ink usage thresholds are defined that are associated with a correspond amount of ink remaining in ink tank 58. These thresholds may be stored, for example, in memory 92 of printhead 56. One threshold of the plurality of thresholds is defined to correspond to a notice threshold. The notice threshold is an ink usage threshold at which it is desired to begin notifying the user of the end of life of the ink supply in ink tank 58. The plurality of thresholds may be defined, for example, in terms of a firing count of at least one of the plurality of ink jetting actuators 82, and more preferably, all of the plurality of ink jetting actuators 82. Preferably, such a firing count is maintained in a memory associated with ink tank 58, such as for example, in logic unit 59 of printhead 56. More particularly, the firing count can be maintained in counter 94, or in memory 92 when functioning as part of the counter. Other of the plurality of count thresholds define progressively lesser levels, or amounts, of ink remaining in ink tank 58.

At step S102, control logic, such as controller 90 and switching unit 96, is provided for selectively individually masking one or more of the address lines, e.g., one or more of the plurality of primary address lines A1–An. Alternatively, such control logic may be incorporated, for example, in controller 26, in printhead interface board 54, or in the software printer driver resident in host 12. Controller 90 will execute a selection routine, further described below, for determining a variable subset of the address lines, such as from among the plurality of primary address lines A1–An, that will be masked via switching unit 96 for a particular horizontal position of printhead 56. Thus, the masking of the address lines is momentary, or at least temporary. Accordingly, when it is determined that at least one of the plurality of address lines is to be masked, the particular address line or combination of address lines that make up the variable subset of the plurality of address lines can be changed from among the plurality of address lines depending, at least in part, upon a position of printhead 56 along main scan path 60.

At step S104, it is determined whether the amount of ink remaining in ink tank 58 has reached the notice threshold. This determination is based, for example, on a comparison of the notice threshold level stored in memory 92 with the count value of counter 94. If NO, step S104 is repeated. If YES, the process proceeds to step S106.

At step S106, upon reaching the notice threshold, an image density of images formed by printhead 56 on print media 76 begins to be progressively reduced by selectively masking at least one of the plurality of address lines, e.g., primary address lines A1–An, and then progressively increasing a number of the plurality of address lines that are masked as each of said plurality of count thresholds in memory 90 is sequentially reached. Preferably, this reduction in the image density is relatively uniform on a particular printed sheet of print media 76, so as to warn the user of the end of life of the ink supply of ink tank 58, and so as not to confuse the user into thinking that a malfunction of printer 14 and/or printhead 56 has occurred. For example, if desired, the progressive reduction in the image density from full density to minimum density can be made to occur within a single printed page, such as for example, by the careful selection of the values for the plurality of ink usage thresholds.

In general, after reaching the notice threshold, the number of address lines that are masked will increase as ink ejections, i.e., firings, from ink ejection nozzles 80 continues. For example, upon reaching the notice threshold, one address line of the plurality of address lines will be masked; upon sequentially reaching the next count threshold, such as the notice threshold plus 5000 nozzle firings, then a total of two address lines will be masked; upon sequentially reaching the next count threshold, such as the notice threshold plus 6,000 nozzle firings, then a total of three address lines will be masked, and so on. The order in which individual ones of the plurality of address lines are masked can be based on a predefined pattern, or individual ones of the plurality of address lines can be masked randomly.

For example, the order of masking among the plurality of address lines can be sequential in an address order sequence of printhead 56. As a further example, the order in which individual address lines of the plurality of address lines are selected to be masked can be selected based on a sequence for minimizing fluidic interference among adjacent ones of the plurality of printhead nozzles 80.

As a further example, upon determining a number of the plurality of address lines that is to be masked, a variable subset of the plurality of address lines is selected, wherein a quantity of address lines in the variable subset is equal to the number of address lines to be masked. The contents of the variable subset can change, for example, depending upon a horizontal position of printhead 56 along main scan path 60. As a further example, the contents of the variable subset can change based on a bit sequence of imaging data at each of a plurality of predefined horizontal positions of printhead 56 along main scan path 60, or based on a predefined address order sequence.

Referring to FIGS. 3 and 4, typically, the order in which address lines, such as primary address lines A1–An, are selected during normal printing is not numerically sequential. In other words, for example, A2 does not immediately follow A1 in the normal address sequence. Rather, some other sequence is predefined in order to minimize fluidic interference between adjacent nozzles. One such sequence, assuming ten address lines, is 7, 4, 1, 8, 5, 2, 9, 6, 3, 10, 7, 4, 1, 8, 5, 2, 9, 6, 3, 10, and so on.

FIGS. 6A–6I depict exemplary predetermined patterns of address line maaking in accordance with the present invention. The axis labeled "Horizontal Position" represents the dot formation positions along main scan path 60. In 600 dots per inch (dpi) printing, for example, each horizontal position represents a movement of printhead 56 a distance of one six-hundredths of an inch along main scan path 60.

FIG. 6A depicts a case where one address line is masked at each horizontal position along main scan path 60, thus forming a subset of the plurality of address lines, but the one address line selected to be masked changes from one horizontal position to the next. In FIG. 5A, the address lines are selected in numerically sequential order, i.e., 1, 2, 3, 4, etc., with each change of horizontal position from left to right, as shown, so as to match the sequence for fluidic interference minimization.

FIG. 6B depicts a case where two address lines are masked at each horizontal position along main scan path 60, thus forming a subset of the plurality of address lines, but the two address lines selected to be masked change from one horizontal position to the next. In FIG. 6B, the address lines are selected in numerically sequential order, with the two address lines for any particular horizontal position being separated by five, i.e., (1,6); (2,7); (3,8); (4, 9); (5,10); etc., with each change of horizontal position from left to right, as shown.

FIG. 6C depicts a case where three address lines are masked at each horizontal position along main scan path 60, thus forming a subset of the plurality of address lines, but the three address lines selected to be masked change from one horizontal position to the next. In FIG. 6C, the address lines are selected in numerically sequential order, with the three address lines for any particular horizontal position being separated by two, and six, i.e., (1,3,7); (2,4,8); (3,5,9); (4,6,10); (5,7,1); (6,8,2); (7,9,3); (8,10,4); etc., with each change of horizontal position from left to right, as shown.

FIG. 6D depicts a case where four address lines are masked at each horizontal position along main scan path 60, thus forming a subset of the plurality of address lines, but the four address lines selected to be masked change from one horizontal position to the next. In FIG. 6D, the address lines are selected in numerically sequential order, with the four address lines for any particular horizontal position being separated by two, i.e., (1,3,5,7); (2,4,6,8); (3,5,7,9); (4,6,8, 10); (5,7,9,1); (6,8,10,2); (7,9,1,3); (8,10,2,4) etc., with each change of horizontal position from left to right, as shown.

FIG. 6E depicts a case where five address lines, thus forming a subset of the plurality of address lines, are masked at each horizontal position along main scan path 60, and in particular, where all odd address lines are masked at odd horizontal positions along main scan path 60, and all even address lines are masked at even horizontal positions along main scan path 60, i.e., (1,3,5,7,9); (2,4,6,8,10); (1,3,5,7,9); (2,4,6,8,10); (1,3,5,7,9); etc., with each change of horizontal position from left to right, as shown. Alternatively, all odd address lines can be masked at even horizontal positions along main scan path 60, and all even address lines can be masked at odd horizontal positions along main scan path 60.

FIG. 6F depicts a case where six address lines, thus forming a subset of the plurality of address lines, are masked at each horizontal position along main scan path 60, and in particular, where all odd address lines are masked at odd horizontal positions along main scan path 60, all even address lines are masked at even horizontal positions along main scan path 60, and a sixth address line is selected as an even number, e.g., 8, in the first horizontal position and changed in numerically sequential order, i.e., 9, 10, 1, 2, etc., with each change of horizontal position from left to right, as shown, i.e., (1,3,5,7,8,9); (2,4,6,8,9,10); (1,3,5,7,9,10); (1,2, 4,6,8,10); (5,7,9,1, 2); etc.

FIG. 6G depicts a case where seven address lines, thus forming a subset of the plurality of address lines, are masked at each horizontal position along main scan path 60, and in particular, with each change of horizontal position from left to right in the pattern, as shown, i.e., (1,2,3,4,6,8,9); (2,3, 4,5,7,9,10); (1,3,4,5,6,8,10); (1,2,4,5,6,7,9); (2,3,5,6,7,8, 10); etc. In other words, wherein the addresses are enabled in a 2,5 pattern, and numerically sequentially increasing by 1 at each horizontal position, to with: (5,7,10); (6,8,1); (7,9,2); (8,10,3); (9,1,4); etc.

FIG. 6H depicts a case where eight address lines, thus forming a subset of the plurality of address lines, are masked at each horizontal position along main scan path 60, and in particular, with each change of horizontal position from left to right in the pattern, as shown, i.e., (1,2,3,4,6,7,8,9); (2,3,4,5,7,8,9,10); (1,3,4,5,6,8,9,10); (1,2,4,5,6,7,9,10); (1,2,3,5,6,7,8,10); etc. In other words, wherein the addresses are not masked in a 5 pattern, beginning with 5, and numerically sequentially increasing by 1 at each horizontal position, to with: (5,10); (6,1); (7, 2); (8,3); (9,4); etc.

FIG. 61 depicts a case where nine address lines, thus forming a subset of the plurality of address lines, are masked at each horizontal position along main scan path 60, and in particular, with each change of horizontal position from left to right in the pattern, as shown, i.e., (1,2,3,4,5,6,7,8,9); (2,3,4,5,6,7,8,9,10); (1,3,4,5,6,7,8,9,10); (1,2,4,5,6,7,8,9, 10); (1,2,3,5,6,7,8,9,10); etc. In other words, wherein the addresses are enabled not masked in a 10 pattern, beginning with 10, and numerically sequentially increasing by 1 at each horizontal position, to with: (10); (1); (2); (3); (4); etc.

FIG. 7 depicts an exemplary predetermined pattern of address line masking in accordance with the present invention, wherein the number of address lines that are masked at each horizontal position vary. Based upon the number of address lines to be masked, the specific address mask pattern may be selected from the examples of FIGS. 6A–6I given above. Thus, depending on the particular horizontal position, the particular address mask pattern for that horizontal position is chosen.

FIG. 8 depicts a pseudo-random selection for address line masking in accordance with the present invention. In this pseudo-random selection, a predetermined number of binary bits of the input data are decoded to determine which address line to mask at the current horizontal position of printhead 56 along main scan path 60. For example, assume that the four most significant bits (MSB) in an input data byte are to be decoded, then the base 10 equivalent to the 4-bit binary number can be found and used to select among sixteen possible address lines for masking.

FIGS. 9A and 9B depict other pseudo-random selections for address line masking in accordance with the present invention.

In the example of FIG. 9A, there is a possibility of up to 13 address lines which can be masked. Based on the determination of the number of address lines to be dropped, e.g., 1 through 12, a sequence of address line masking will occur. While the sequence is predictable, i.e., by two's, beginning with 1, and then after all the odd address lines are used, additionally the even address lines by two's starting at 2, the actual pattern seen at printhead is pseudo-random in view of the sequence predefined to minimize fluidic interference between adjacent nozzles, e.g., 7, 4, 1, 8, 5, 2, 9, 6, 3, 10, etc.

In the example of FIG. 9B, again, there is a possibility of up to 13 address lines which can be dropped. Based on the horizontal position of printhead 56 along main scan path 60, i.e., 1 through 14 in this example, a sequence of groupings of multiple address line masking will occur. In the pattern of FIG. 9B, three address lines will be dropped at each horizontal position of printhead 56 along main scan path 60, in the sequence: odd beginning with 1; even beginning with 2; odd beginning with 3; even beginning with 4; odd beginning with 5; even beginning with 6; odd beginning with 7; even beginning with 8; odd beginning with 9; even beginning with 10, etc.

While the preferred location for the control logic for selectively and individually masking address lines associated with ink jetting actuators 82 in a progressive manner is in/on printhead 56 or ink tank 58, it is contemplated that such control logic may be located at other locations in printer 14, such as controller 26, printhead driver 34 or printhead interface board 54. Alternatively, it is contemplated that the control logic could be located in the printer driver software executed at host 12.

Also, supplemental to infoming the user of the end of life of the ink supply in ink tank 58 by a progressive reduction in the image density of the printed images, as each of the plurality of count thresholds is sequentially reached, various messages can be displayed on user interface 16 of host 12 and/or user interface 28 of printer 14. For example, a page count can be maintained by controller 26, as well as a total count of the firings of the plurality of actuators 82, from which an average of actuator firings per page can be readily calculated. By determining, for example empirically, an amount of ink remaining in ink tank 58 at each of the plurality of count thresholds in terms of an actuator firing count, an estimation can be calculated of the number of pages that can yet be printed at the previous rates of coverage before exhaustion of the ink supply in ink tank 58, and controller 26 can generate a message to that effect, which in turn can be displayed at one or both of user interfaces 16 and 28.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of informing a user of an ink jet printer of the end of life of a consumable, said consumable supplying ink to a printhead, said ink jet printer being adapted for reciprocating movement of said printhead along a main scan path, said printhead including a plurality of ink ejection nozzles and an associated plurality of ink jetting actuators, each of said plurality of ink jetting actuators being addressable, said printhead including a plurality of address lines for facilitating selection of one or more of said plurality of ink jetting actuators, said method comprising the steps of:

defining a notice threshold that is associated with a corresponding amount of ink remaining in said consumable;

providing control logic for selectively controlling said plurality of address lines;

determining a number of said plurality of address lines that is to be masked;

selecting a variable subset of said plurality of address lines, wherein a quantity of address lines in said variable subset is equal to said number;

determining whether said amount of ink remaining in said consumable has reached said notice threshold; and upon reaching said notice threshold, reducing an image density of images formed by said printhead by selectively masking said number of said plurality of address lines.

2. The method of claim 1, wherein the contents of said variable subset changes based upon a position of said printhead along said main scan path.

3. The method of claim 1, further comprising the step of changing contents of said variable subset of said plurality of address lines based on a predefined pattern.

4. The method of claim 3, wherein said predefined pattern is an address order sequence of said printhead.

5. The method of claim 1, further comprising the step of changing contents of said variable subset of said plurality of address lines based on random selection.

6. The method of claim 1, further comprising the step of changing contents of said variable subset of said plurality of address lines based on a sequence for minimizing fluidic interference among adjacent ones of said plurality of printhead nozzles.

7. The method of claim 1, further comprising the step of changing contents of said variable subset of said plurality of address lines based on a bit sequence of imaging data at each of a plurality of predefined positions of said printhead along said main scan path.

8. A method of informing a user of an ink jet printer of the end of life of a consumable, said consumable supplying ink to a printhead, said ink jet printer being adapted for reciprocating movement of said printhead along a main scan path, said printhead including a plurality of ink ejection nozzles and an associated plurality of ink jetting actuators, each of said plurality of ink jetting actuators being addressable, said printhead including a plurality of address lines for facilitating selection of one or more of said plurality of ink jetting actuators, said method comprising the steps of:

defining a notice threshold that is associated with a corresponding amount of ink remaining in said consumable;

providing control logic for selectively controlling said plurality of address lines;

determining whether said amount of ink remaining in said consumable has reached said notice threshold; and upon reaching said notice threshold, reducing an image density of images formed by said printhead by selectively masking at least one of said plurality of address lines, wherein when it is determined that said at least one of said plurality of address lines is to be masked, a number of individual address lines of said plurality of address lines selected to be masked will change depending upon a position of said printhead along said main scan path.

9. The method of claim 8, further comprising the step of choosing an address mask pattern based on said position of said printhead along said main scan path.

10. The method of claim 9, wherein said address mask pattern is an address order sequence of said printhead.

11. The method of claim 9, wherein said address mask pattern is a sequence for minimizing fluidic interference among adjacent ones of said plurality of printhead nozzles.

12. The method of claim 9, wherein said step of choosing said address mask pattern is further based on a bit sequence of imaging data at each said position of said printhead along said main scan path.

* * * * *